US009335740B2

(12) United States Patent
Umamoto

(10) Patent No.: US 9,335,740 B2
(45) Date of Patent: May 10, 2016

(54) TIMEPIECE CAPABLE OF INTEGRALLY INDICATING TIME AND PHYSICAL QUANTITIES

(75) Inventor: Eiichi Umamoto, Shinjuku (JP)

(73) Assignee: NIHON TECHNO CO., LTD. (JP)

( * ) Notice: Subject to any disclaimer, the term of this patent is extended or adjusted under 35 U.S.C. 154(b) by 0 days.

(21) Appl. No.: 14/373,762

(22) PCT Filed: May 31, 2012

(86) PCT No.: PCT/JP2012/064162
§ 371 (c)(1),
(2), (4) Date: Jul. 22, 2014

(87) PCT Pub. No.: WO2013/179458
PCT Pub. Date: Dec. 5, 2013

(65) Prior Publication Data
US 2014/0355390 A1 Dec. 4, 2014

(51) Int. Cl.
*G04B 47/06* (2006.01)
*G04G 9/00* (2006.01)

(52) U.S. Cl.
CPC ..... *G04B 47/06* (2013.01); *G04B 47/061* (2013.01); *G04G 9/0064* (2013.01)

(58) Field of Classification Search
CPC .... G04B 19/048; G04B 47/06; G04B 47/061; G04B 47/063; G04G 9/0064; G04G 21/00; G04G 21/02; G01R 22/10
USPC ..... 368/11, 80, 223, 239–241, 82–84
See application file for complete search history.

(56) References Cited

U.S. PATENT DOCUMENTS 4,312,056 A * 1/1982 Nishimura ..... G04G 9/087 368/21
4,995,015 A * 2/1991 Chiang ..... G04B 47/06 368/10
6,842,402 B2 * 1/2005 Germiquet ..... G04G 21/02 368/10
7,269,100 B2 * 9/2007 Gilomen ..... G04G 21/02 368/11

(Continued)

FOREIGN PATENT DOCUMENTS

JP 2001-116593 A 4/2001
JP 2002-122446 A 4/2002

(Continued)

*Primary Examiner* — Amy Cohen Johnson
*Assistant Examiner* — Matthew Powell
(74) *Attorney, Agent, or Firm* — Harness, Dickey & Pierce, P.L.C.

(57) ABSTRACT

With conventional timepieces, information about target physical quantities, target achievement, and time has been indicated using separate displays, thereby making it difficult for users to instantly understand whether or not a target has been achieved. Therefore, a timepiece comprising a dual-purpose scale for integrally indicating time and physical quantities, a physical quantity information acquisition unit for obtaining the information about the physical quantities described above, a physical saving quantity information acquisition unit for obtaining physical saving quantity information indicating the physical quantity to be obtained by the current time within a time segment, a time display unit for displaying the time on the dual-purpose scale, an achieved value information acquisition unit for obtaining information on a quantity achieved up to the current time for the physical quantity, and a quantity variance display unit for indicating the variance in quantity obtained from achieved value and physical saving quantity is proposed.

7 Claims, 13 Drawing Sheets

(56) References Cited

U.S. PATENT DOCUMENTS

| | | | | |
|---|---|---|---|---|
| 7,869,308 | B2 * | 1/2011 | Rochat | B63C 11/02 368/101 |
| 2004/0218472 | A1 * | 11/2004 | Narayanaswami | G04G 9/02 368/10 |
| 2004/0233788 | A1 * | 11/2004 | Plancon | G04B 19/082 368/11 |
| 2007/0183264 | A1 * | 8/2007 | Raeber | B63C 11/32 368/11 |
| 2009/0185452 | A1 * | 7/2009 | Veuthey | G04G 21/02 368/11 |
| 2013/0286793 | A1 | 10/2013 | Umamoto | |

FOREIGN PATENT DOCUMENTS

| | | | |
|---|---|---|---|
| JP | 2009-085935 | A | 4/2009 |
| JP | 4775749 | B1 | 9/2011 |
| JP | 5332069 | B1 | 11/2013 |

* cited by examiner

TIMEPIECE CAPABLE OF INTEGRALLY INDICATING TIME AND PHYSICAL QUANTITIES

CROSS-REFERENCE TO RELATED APPLICATIONS

This application is a U.S. National Stage Application of International Application No. PCT/JP2012/064162 filed on May 31, 2012, and published in Japanese as WO 2013/179458A1 on Dec. 5, 2013. The entire disclosure of the above application is incorporated herein by reference.

FIELD OF THE INVENTION

The present invention relates to a timepiece capable of integrally denoting both time and physical quantities.

BACKGROUND OF THE INVENTION

Conventionally, various types of timepieces that allow indication of information about physical quantity as well as time information have been known, such as wristwatches and table clocks. For example, according to Unexamined Japanese Patent Application Publication No. 2009-85935, a target display timepiece in a digital format that allows numerical indication of the current degree of achievement compared with a desired target for a certain period is disclosed. Additionally, according to Japanese Examined Patent Application Publication No. 5332069, a timepiece that allows easy understanding of the extent of power consumption at the current time compared with a target level or the like is disclosed.

SUMMARY OF THE INVENTION

Problems to be Solved by the Invention

With conventional timepieces, information about target physical quantities, the degree of target achievement, and time has been indicated using separate displays. Thus, it has been necessary for users to distinguish the aforementioned information individually, thereby making it difficult for users to instantly understand whether or not a target has been achieved.

Means for Solving the Problems

In order to solve the aforementioned problems, the present invention proposes a timepiece comprising a dual-purpose scale for integrally indicating a physical quantity to be controlled using information about obtained target values established for times and time segments, a physical quantity information acquisition unit for obtaining information about the physical quantity associated with time, a physical saving quantity information acquisition unit for obtaining physical saving quantity information indicating the physical quantity to be obtained by the current time within a time segment using information on average physical quantity in the form of an average resulting when target values obtained within given time segments are divided by a time segment length, a time display unit for displaying the time on the dual-purpose scale, an achieved value information acquisition unit for obtaining information on a quantity achieved up to the current time for the physical quantity controlled within a given time segment, and a quantity variance display unit for indicating the variance in quantity resulting when physical saving quantity up to the current time within a predetermined time segment is subtracted from the achieved quantity, such variance being represented by a higher value than the value for the current time when the variance is of a positive nature, and being represented by a lower value than the value for the current time when the variance is of a negative nature, under the condition that the variance is reckoned from the value for the current time shown on the dual-purpose scale.

Effects of the Invention

According to the present invention having the above configuration, users can simultaneously recognize the time and the specific degree of target achievement at the current time using a single scale. Therefore, users are able to instantly understand the aforementioned information and undertake timely action based on the degree of target achievement.

DETAILED DESCRIPTIONS OF PREFERRED EMBODIMENTS

Embodiments of the present invention will be described hereinafter with reference to the drawings. The mutual relationship between the embodiments and the aspects of the current disclosure is described as follows.

A first embodiment will mainly describe the first aspect of the current disclosure. A second embodiment will mainly describe the second aspect of the current disclosure. A third embodiment will mainly describe the third aspect of the current disclosure. The present invention is not limited to the above embodiments and may be embodied in various forms without exceeding the scope thereof.

First Embodiment

Concept of First Embodiment

Figure 1:
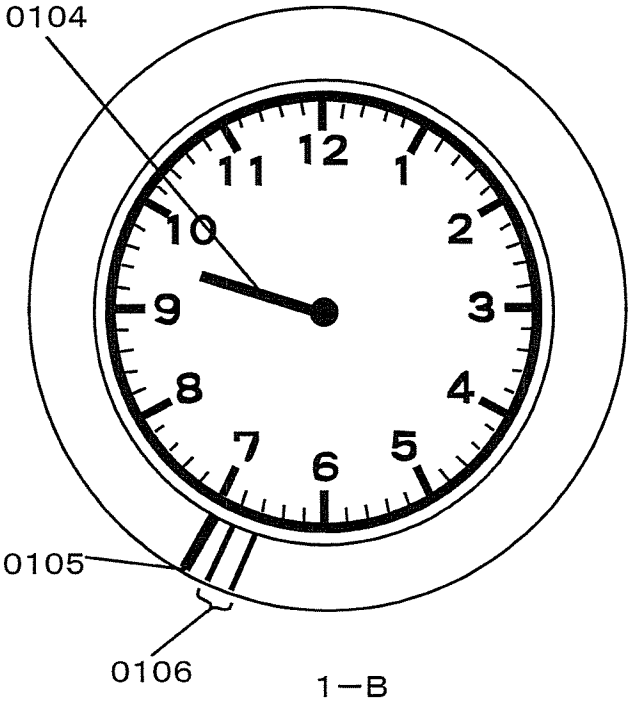
FIG. 1 is a diagram showing a concept of a timepiece of a first embodiment.
Figure 1:
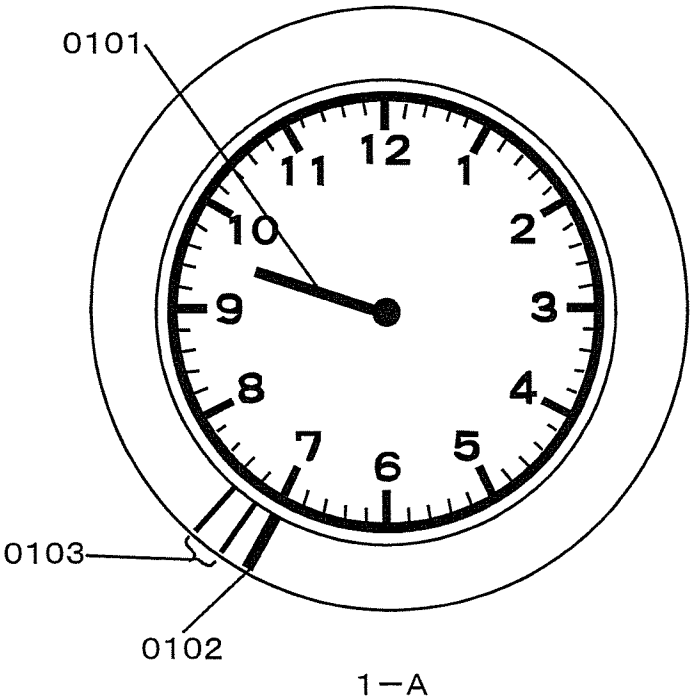
Figure 2:
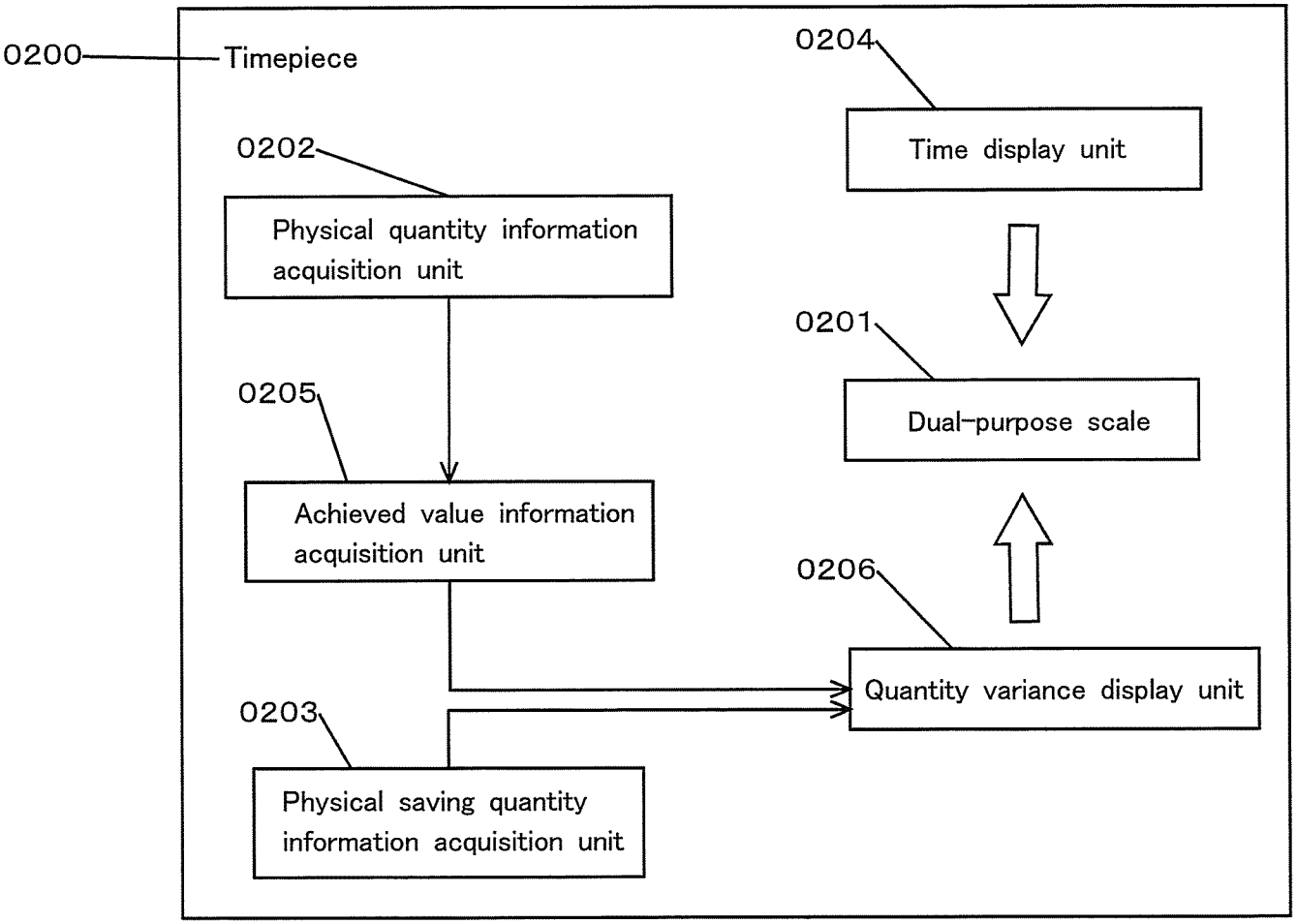
FIG. 2 is a diagram showing an example of functional block of the timepiece of the first embodiment.

FIG. 1 is a diagram showing a concept of a timepiece of a first embodiment. As depicted in FIG. 1, a "timepiece" of a first embodiment is characterized as follows. That is to say, such timepiece indicates the time within a dual-purpose scale. Furthermore, such timepiece obtains physical quantity information about the physical quantity associated with time, obtains physical saving quantity information indicating the physical quantity to be obtained by the current time within a time segment using information on average physical quantity in the form of an average resulting when target values obtained within given time segments are divided by a time segment length, obtains information on a quantity achieved up to the current time for the physical quantity controlled within a given time segment, and indicates the variance in quantity resulting when physical saving quantity up to the current time within a predetermined time segment is subtracted from the achieved quantity, such variance being represented by a higher value than the value for the current time when the variance is of a positive nature, and being represented by a lower value than the value for the current time when the variance is of a negative nature, under the condition that the variance is reckoned from the value for the current time shown on the dual-purpose scale. The timepiece inserted in FIG. 1 shows the time as 9:35. FIG. 1-A indicates that the variance is of a positive nature. FIG. 2-B indicates that the variance is of a negative nature.

Functional Configuration of First Embodiment

FIG. 2 is a diagram showing an example of a functional block of the timepiece of the first embodiment. As described in FIG. 2, a timepiece 0200 of the first embodiment comprises a dual-purpose scale 0201, a physical quantity information acquisition unit 0202, a physical saving quantity information acquisition unit 0203, a time display unit 0204, an achieved value information acquisition unit 0205, and a quantity variance display unit 0206.

The term "dual-purpose scale" refers to a scale for integrally indicating a physical quantity to be controlled using information about obtained target values established for times and time segments. Such dual-purpose scale is composed of a plurality of bars that indicates time segments and a display surface with a function for indicating such bars on the timepiece. That is to say, it is possible to simultaneously indicate the time and physical quantity information using a single scale. In addition, a configuration in which a dial for indicating the time corresponding to the bars is added to the timepiece surface is acceptable. It is possible for the main location for allocation of the dual-purpose scale to be at the edge of the dial for indicating the time for the timepiece as described in FIG. 1. However, as long as the information about the time and physical quantities can be integrally indicated, such main location is not limited to the aforementioned location. The number of bars for the dual-purpose scale can be 60, as is generally the case with ordinary timepieces. Multiplies of 60 (e.g., 120 or 240) or common divisors of 60 (e.g., 12 or 4) may be established. Such values may be determined arbitrarily.

The term "obtained target values established for times and time segments" refers to obtained target values for physical quantities that can be increased or decreased over multiple time segments. Here, a configuration in which obtained target values can be changed over time segments is possible. In case that a physical quantity to be controlled is electric power, for example, there is a difference between the quantity of electric power consumed during the nighttime period and that consumed during the daytime period. Thus, it is possible to change the setting so as to set a higher target value for the nighttime period than that for the daytime period.

Regarding the time segment used as a standard for setting of target values, for example, it is possible to establish 30 minutes as a single time segment. Alternatively, 5, 15, or 60 minutes are acceptable. It is possible to maintain information about obtained target values in an internal storage unit in advance or to create a configuration whereby such information is obtained from an external device via a wired or wireless communication line. Furthermore, it is also possible to accept operation inputs as necessary by using operation input equipment.

The term "a physical quantity to be controlled using information about obtained target values established for times and time segments" refers to a physical quantity that is used to enable users to recognize whether or not target values are exceeded and which should be controlled for achievement of the corresponding target.

The "physical quantity information acquisition unit" retains the function for acquiring information about the aforementioned physical quantity associated with time. There are various types of information about a physical quantity to be obtained. Examples include power consumption at a corresponding time (i.e., power consumption quantity at a given time), operation speed for a treadmill, or the like. However, the aforementioned types of information are not limited by such examples. In addition, the term "associated with time" is used with reference to information about a physical quantity obtained at a specific time. More specifically, the term "physical quantity" is not used with reference to a value obtained as a result of continuous information acquisition within a certain period, but a value individually obtained at specific time, such as 4:30 p.m. or 4:44 p.m., for example.

In addition, a physical quantity is represented with a value that becomes the basis for achieved value and quantity variance to be obtained subsequently. Thus, it is necessary for information about such physical quantity to be obtained at an earlier stage than that at which information is acquired about the achieved value and quantity variance. Concretely, regarding the preferred method for display for users, it is desirable for the quantity variance display to change together with changes in time display. Thus, a configuration whereby the information about a physical quantity is obtained at shorter intervals than the minimum interval at which displayed time changes is possible. The term "minimum interval at which displayed time changes" refers to the shortest interval at which the display changes to indicate the progression of time via the dual-purpose scale. For example, in case that there are 60 bars on the the dual-purpose scale, the "shortest interval" is 1 minute. Thus, in the case of the aforementioned example, it is desirable to obtain the information about a physical quantity on a less-than-once-per-minute basis.

Means for acquisition of the information about a physical quantity can be configured such that such information is obtained via a detector, such as a temperature sensor or an accelerometer, can be configured such that such information is obtained via operation input equipment, or configured such that such information is obtained via a wired or wireless communication line. As a configuration using a communication line, it is acceptable to use a form of power line communication (PLC) utilizing power lines.

The "physical saving quantity information acquisition unit" retains the function for obtaining physical saving quantity information indicating the physical quantity to be obtained by the current time within a time segment using information on average physical quantity in the form of an average resulting when target values obtained within given time segments are divided by a time segment length. The term "average physical quantity" refers to a target value per unit of time for a physical quantity. The "unit of time" can be 1 minute for normal timepieces. Acquisition of the corresponding values makes it possible to confirm the information about obtained target values for time segments as well as further segmented units of time.

The relationship between obtained target value and physical saving quantity is explained hereinafter using a specific power consumption quantity as an example. For example, in case that the obtained target value for power consumption quantity for 30 minutes from 4:30 p.m. until 5:00 p.m. is set at 6,000 kWh, the average physical quantity can be computed to be 200 kW per minute as a unit of time. Therefore, based on such setup, the physical saving quantity at 4:45 p.m. is computed to be 3,000 kWh, and the physical saving quantity at 4:50 p.m. is computed to be 4,000 kWh.

Figure 3:
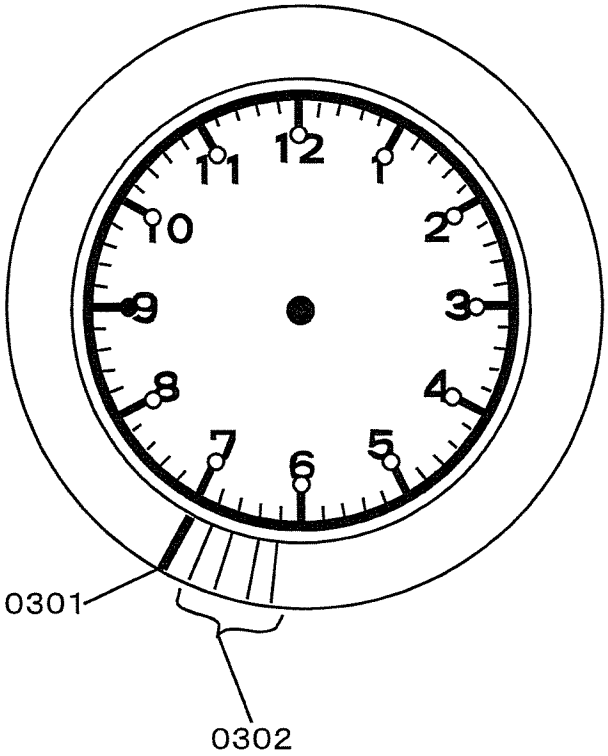
FIG. 3 is a diagram showing an example of another timepiece 1 of the first embodiment.

The "time display unit" retains the function for indicating time on the dual-purpose scale. The expression "indicating time on the dual-purpose scale" refers to a method for indicating time that allows visual recognition of time based on the information shown on the dual-purpose scale, which is one part of a whole timepiece. By adoption of the method for display described above, time may be displayed without the use of some or all needles, such as minute hands and hour hands, used conventionally in timepiece displays, for example. More specifically, as described in FIG. 3, the following methods for display are possible. For example, the portion corresponding to the time to be shown by a minute hand on a conventional timepiece can be indicated within the dual-purpose scale. The portion corresponding to the time segment to be shown by a hour hand therefor can be indicated at the targeted location between the portion showing a physical quantity of the dual-purpose scale and the dual-purpose scale. According to the timepiece of the first embodiment, adoption of the configuration described above makes it possible to simultaneously recognize the specific degree of target achievement at the current time as well as time based on a single scale. Therefore, it is possible to understand the aforementioned information instantly and to undertake timely action based on the degree of target achievement.

The "achieved value information acquisition unit" retains the function for obtaining information on a quantity achieved up to the current time for the physical quantity controlled within a given time segment. More specifically, the achieved value information acquisition unit retains the function for obtaining information on an integrated physical quantity that has been continuously acquired via the physical quantity information acquisition unit during a period from the commencement of a time segment until the current time. In response to the example of the physical quantity described above, the achieved value information acquisition unit can be configured to obtain power consumption quantity information up to the current time based on the acquired power consumption and to obtain total running distance or calorie consumption based on the obtained speed of a treadmill. Adoption of the configuration outlined above makes it possible to understand the obtained physical quantity associated with time based on a certain unit of time, and as a result, to compute quantity variance using the physical saving quantity information described below.

The "quantity variance display unit" retains the function for indicating the variance in quantity resulting when physical saving quantity up to the current time within a predetermined time segment is subtracted from the achieved quantity, such variance being represented by a higher value than the value for the current time when the variance is of a positive nature, and being represented by a lower value than the value for the current time when the variance is of a negative nature, under the condition that the variance is reckoned from the value for the current time shown on the dual-purpose scale. The expression "variance in quantity resulting when physical saving quantity up to the current time within a predetermined time segment is subtracted from the achieved quantity" specifically refers to a value indicating whether or not an achieved value exceeds a physical saving quantity. Computation of the aforementioned quantity variance makes it possible to indicate whether or not an achieved value at the current time within a predetermined time segment exceeds a target, and to allow users to understand the aforementioned information. Therefore, in case that power consumption quantity, for example, is obtained in the form of an achieved value, acquisition of quantity variance makes it possible for users to understand whether or not such users are undertaking targeted energy-saving actions. In case that the number of calories consumed during continuous exercise using a treadmill or the like is obtained, it is possible to determine whether or not exercise quantity necessary for targeted caloric consumption has been achieved.

The expression "such variance being represented by a higher value than the value for the current time when the variance is of a positive nature, and being represented by a lower value than the value for the current time when the variance is of a negative nature, under the condition that the variance is reckoned from the value for the current time shown on the dual-purpose scale" refers a situation in which, when the aforementioned variance is of a positive nature or a negative nature, separate indication is made within the dual-purpose scale, in addition to indication of the current time. In cases in which the aforementioned variance is of a positive nature, the achieved value is indicated as exceeding the physical saving quantity. In cases in which the aforementioned variance is of a negative nature, the achieved value is indicated as falling below the physical saving quantity. In other words, it is indicated on the dual-purpose scale that the goal has been exceeded in the former case and that the goal has not been exceeded in the latter case.

A method for indication of the extent of quantity variance (i.e., the ratio between the dual-purpose scale value and quantity variance value) can be implemented based on the unit established for the physical saving quantity and the number of bars on the dual-purpose scale. More specifically, an example of a case in which obtained physical quantity is an amount of power consumed is explained using specific numerical values. In case that the obtained target value is 6,000 kWh for a 30-minute time segment, physical saving quantity for the current time would be 4,000 kWh. However, the achieved value is 5,000 kWh after the elapse of 20 minutes. In such case, the quantity variance is is 1,000 kWh, which is of a positive nature. In such case, the number of scale bars for the time segment is 30, and the quantity variance per bar is 200 kWh. Thus, in such case, such variance is represented by 5 bars that extend beyond the value for the current time (specific example 1). In contrast, in case the achieved value is 1,600 kWH, the variance for the current time is negative 2,400 kWH. Thus, in such case, such variance is represented by the absence of 12 bars below the value for the current time (specific example 2). When users see the timepieces on which the aforementioned results are indicated, such users can recognize the need to undertake energy-saving actions to reduce power consumption to an extent corresponding to 5 minutes of consumption in the case of specific example 1, and such users can recognize that there is leeway for 12 minutes of consumption in the case of specific example 2. Adoption of the configuration described above for the method for indication using the dual-purpose scale makes it possible for users to recognize the physical saving quantity associated with time as well as the achieved value, when such users see timepieces.

Thereby, it is possible for such users to undertake timely actions based on the degree of target achievement.

Figure 4:
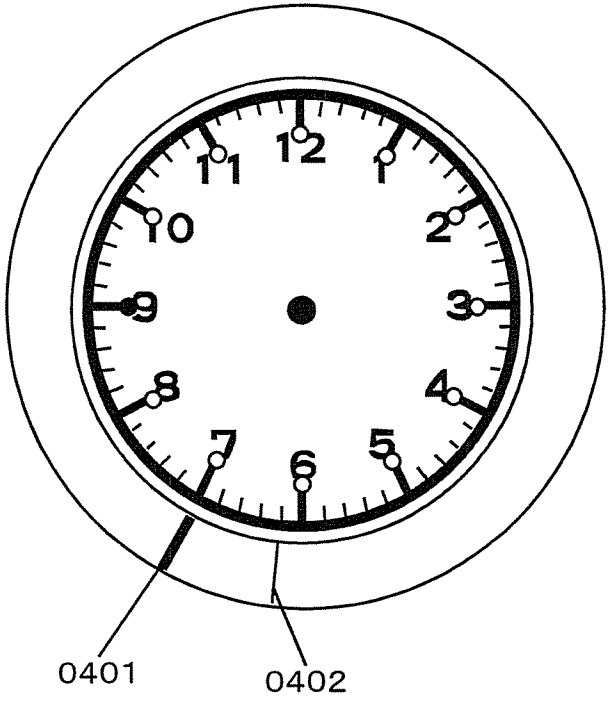
FIG. 4 is a diagram showing an example of another timepiece 2 of the first embodiment.

The aforementioned method for display is only an example, and thus, as a matter of course, it is possible to use another form of display. In concrete terms, the same form of indication is possible for all corresponding bars of the dual-purpose scale. Furthermore, as described in FIG. 4, the head portion alone of bars representing a higher value than the value for the current time and representing a lower value than the value for the current time of the dual-purpose scale can be used.

Moreover, indication for display of quantity variance using the timepiece of the first embodiment takes place using the same dual-purpose scale that indicates the current time. Thus, it is desirable to indicate the quantity variance with a display that differs in form from the form used to indicate current time, insofar as is possible, so that users are able to recognize both variance and time by distinguishing therebetween. For example, in case that the current time is indicated in the form of light emission, a configuration in which the quantity variance is indicated using a form of blinking or a configuration in which the current time is indicated by an elements of a different color than that used to indicate quantity variance or by a thick line is possible.

Figure 5:
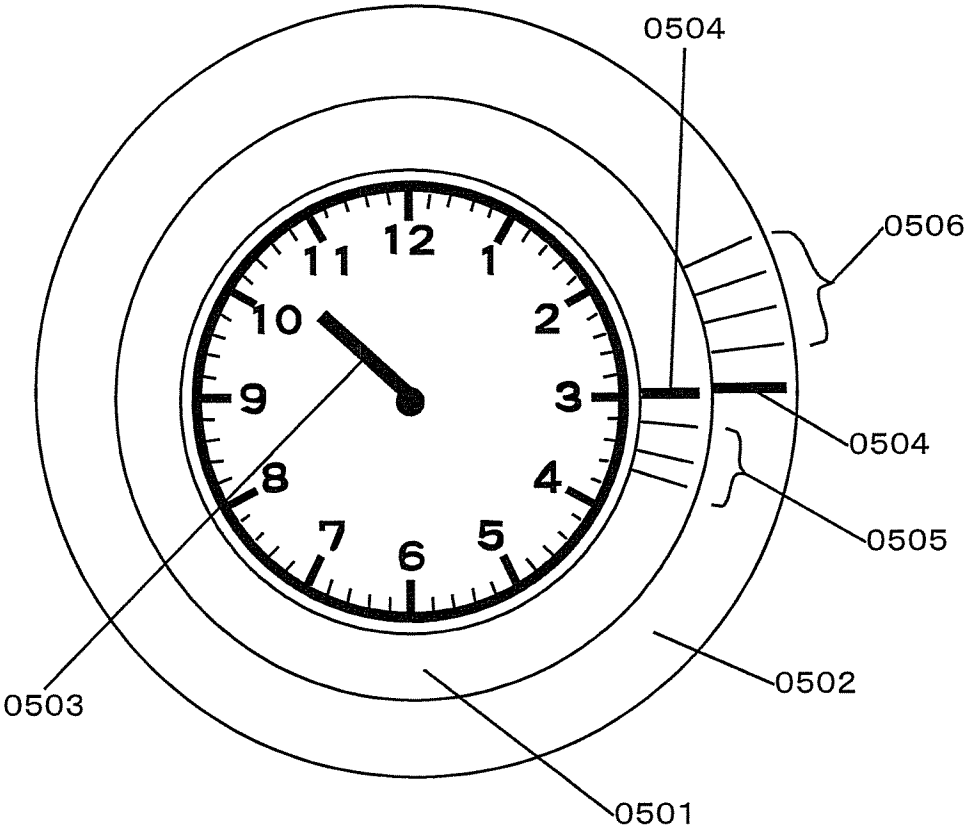
FIG. 5 is a diagram showing an example of another timepiece 3 of the first embodiment.

In addition, in case that there are a plurality of physical quantities represented using the dual-purpose scale, a configuration in which a plurality of display surfaces are established in order to indicate such physical quantitates on the dual-purpose scale is possible. For example, as shown in FIG. 5, in relation to the physical quantity A, a configuration in which the corresponding quantity variance A is indicated with a "display surface A" 0501 allocated outside of the dial of the timepiece so as to encircle such dial is possible. In relation to the physical quantity B, a configuration in which the corresponding quantity variance B is indicated with a "display surface B" 0502 allocated outside of the display surface A so as to encircle such surface is possible. In case that the aforementioned configuration is adopted, it is possible to use display surfaces that employ different intervals corresponding to information to be obtained on different physical quantities. More specifically, the display surface A may indicate quantity variance in 5-minute intervals, while display surface B may indicate quantity variance in 12-hour intervals. Even in cases in which a plurality of physical quantities are controlled, adoption of the aforementioned configurations makes it possible to understand the degree of target achievement for each physical quantity at a glance.

Concrete Configuration

Figure 6:
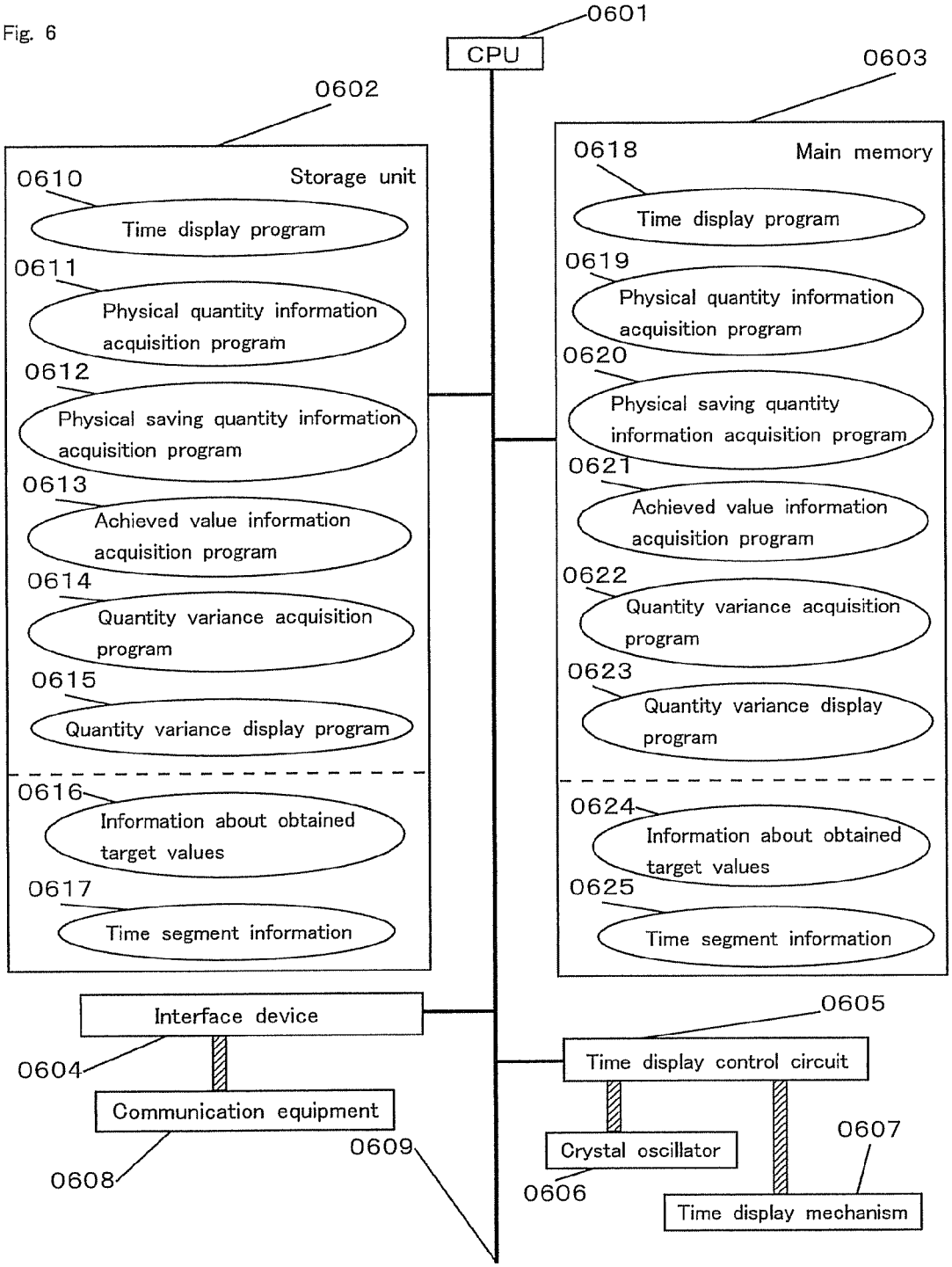
FIG. 6 is a diagram showing an example of a hardware configuration of the timepiece of the first embodiment.

FIG. 6 is a schematic diagram showing an example of a hardware configuration of the timepiece depicted above. Operations for hardware configuration units are explained hereinafter with reference to FIG. 6.

As described in FIG. 6, the timepiece comprises a "CPU" 0601, a "storage unit (storage medium)" 0602, a "main memory" 0603, an "interface" 0604, and a "time display control circuit" 0605. The time display control circuit transmits and receives signals with a "crystal oscillator" 0606 and a "time display mechanism" 0607. It is possible for the interface to receive data signals and the like for physical quantities with "communication equipment" 0608. Various forms of programs stored in the storage unit and the like are executed by being loaded into the main memory. The configuration described above is connected via a data communication path, which is a "system bus" 0609, and transmission, receipt, and processing of information takes place.

Concrete Processing Via Time Display Unit

The CPU executes a "time display program" 0618, processes conversion of signals obtained via the time display control circuit from the crystal oscillator into time display information, and stores the processed results in the time display control circuit. The time display control circuit processes display of the time for the time display mechanism based on the aforementioned time display information.

Concrete Processing via Physical Quantity Information Acquisition Unit

The CPU executes a "physical quantity information acquisition program" 0619, processes acquisition of information about physical quantities from communication equipment via the interface, and stores the processed results in a predetermined address of the main memory.

Concrete Processing Via Physical Saving Quantity Information Acquisition Unit

The CPU executes a "physical saving quantity information acquisition program" 0620, divides "information about obtained target values" 0624, which were preserved in advance, by a time segment length, which was also preserved in the same manner, and then stores the results in a predetermined address of the main memory. Furthermore, the obtained values resulting from the aforementioned process are multiplied by the time that has elapsed following the commencement of the time segment until the current time, and the results thereof are stored in a predetermined address of the main memory.

Concrete Processing Via Achieved Value Information Acquisition Unit

The CPU executes an "achieved value information acquisition program" 0621, processes integration of physical quantities obtained from the commencement of a time segment until the current time, and stores the processed results in a predetermined address of the main memory.

Concrete Processing Via Quantity Variance Display Unit

The CPU executes a "quantity variance acquisition program" 0622, subtracts an achieved value from the already stored physical saving quantity value, and stores the processed results in a predetermined address of the main memory. Thereafter, the CPU further executes a "quantity variance display program" 0623, and executes the processing for quantity variance indication based on the aforementioned processed result.

Progression of Process of First Embodiment

Figure 7:
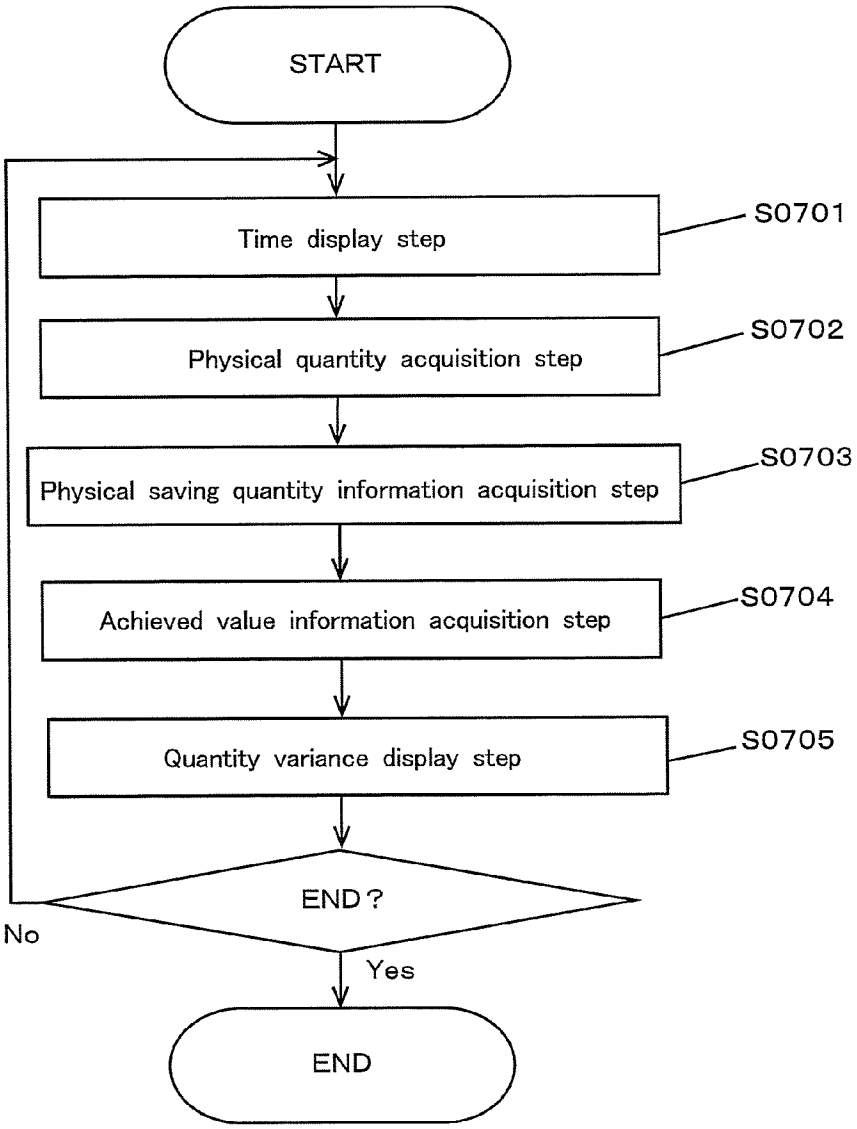
FIG. 7 is a diagram showing progression of the process of the timepiece of the first embodiment.

FIG. 7 is a diagram showing progression of the process of the timepiece of the first embodiment. The progression of the process of FIG. 7 comprises the following steps. Initially, scale display for indicating the dual-purpose scale based on the time takes place (step S0701: time display step). Subsequently, the physical quantity information reckoned from a predetermined time is obtained (step S0702: physical quantity acquisition step). Next, the information about average physical quantity in the form of an average resulting when obtained target values are divided by a time segment length is obtained, and the physical saving quantity information to be obtained reckoned from a predetermined time until the current time is obtained (S0703: physical saving quantity information acquisition step). Next, achieved value information representing the value achieved up to the current time for a quantity achieved for the physical quantity controlled within a given time segment is acquired (S0704: achieved value information acquisition step). Quantity variance resulting when physical saving quantity value is subtracted from the achieved value is computed, and scale display indicating the dual-purpose scale based on the corresponding quantity variance takes place (S0705: quantity variance display step).

Figure 14:
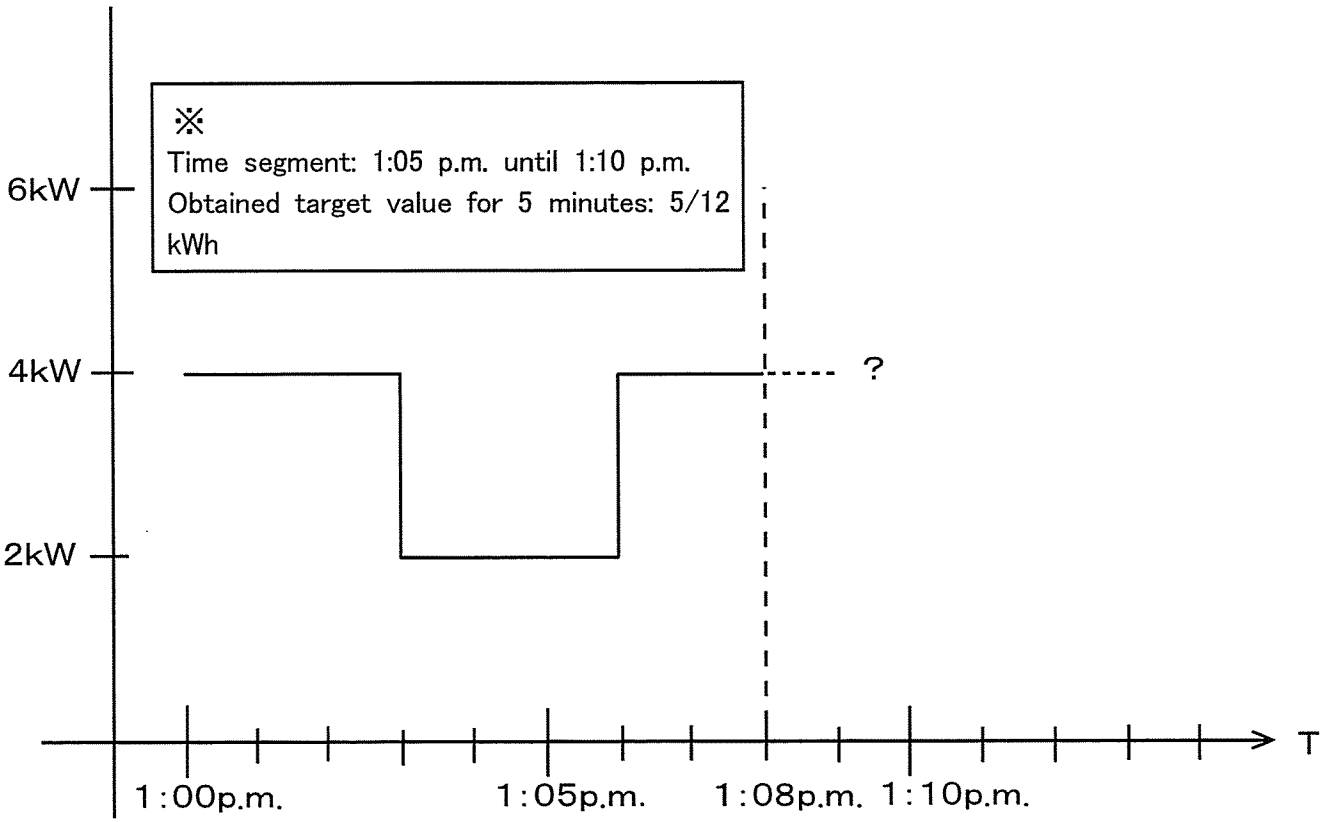
FIG. 14 is a diagram showing an example of change of physical quantity indicated via the timepiece of the first embodiment.

FIG. 14 is a diagram showing an example of change of physical quantity indicated via the timepiece of the first embodiment. In FIG. 14, the horizontal axis represents the time and the vertical axis represents electric power as a physical quantity obtained. In addition, the time segment represents 5 minutes from 1:05 p.m. until 1:10 p.m. and the obtained target value during such period is 5/12 kWh. In case that the aforementioned condition applies to a timepiece with a 60-bar dual-purpose scale, the number of bars for the relevant time segment is 5. Thus, the physical quantity equivalent to a single bar of the dual-purpose scale is 1 kW, and the physical saving quantity is 1/12 kWh.

As described in FIG. 14, power consumption at 1:05 p.m. is 2 kW (and the power consumption quantity is 2/50 kWh), power consumption at 1:06 p.m. is 4 kW (and power consumption quantity is 4/60 kWh), and power consumption at 1:07 p.m. is 4 kW (and power consumption quantity is 4/60 kWh). That is to say, the achieved value for the corresponding 3 minutes is 2/12 kWh. At the same time, the physical saving quantity for 3 minutes is 3/12 kWh, as described above. That is to say, the variance between the achieved value and the obtained target value is negative 1/12 kWh. Thus, in such case, the variance represented by the absence of 1 bars below the value for the current time of the dual-purpose scale can be indicated. Based on such indication, users can recognize the need to undertake energy-saving actions to reduce power consumption to an extent corresponding to 1 minute of consumption.

Brief Description of Effects of First Embodiment

Adoption of the corresponding configuration of the timepiece of the first embodiment makes it possible to integrally indicate the current time and physical quantities to be controlled. Thus, even when users casually view such timepiece, it is possible for them to recognize visually a physical quantity to be controlled and the current time in an integral manner, and to easily understand to what extent a physical quantity to be controlled at the current time has changed.

Second Embodiment

Concept of Second Embodiment

Figure 8:
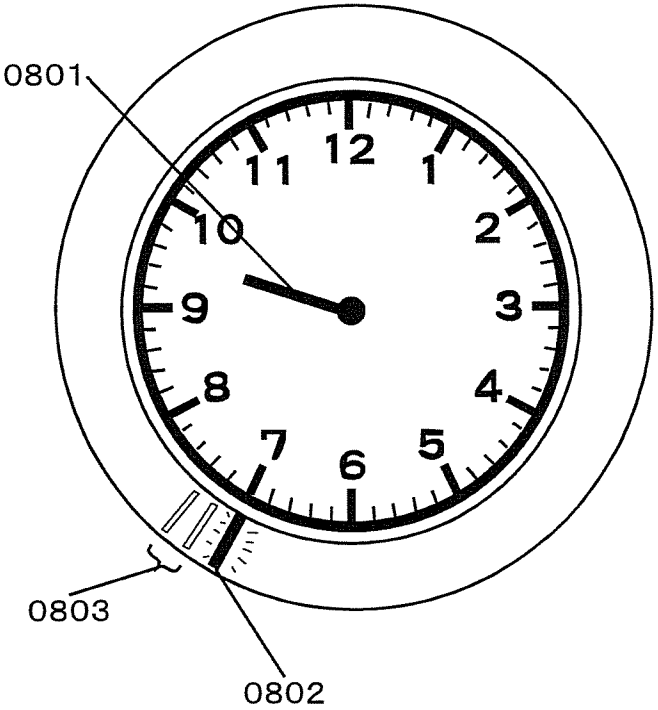
FIG. 8 is a diagram showing a concept of a timepiece of a second embodiment.

FIG. 8 is a diagram showing a concept of a timepiece of a second embodiment. As described in FIG. 8, the timepiece of the second embodiment is basically the same as that explained in the first embodiment. However, the timepiece of the second embodiment is characterized in that the dual-purpose scale is composed of a light-emitting unit using multicolored light-emitting components. Such configuration makes it possible to represent a physical quantity and time using a plurality of colors.

Functional Configuration of Second Embodiment

Figure 9:
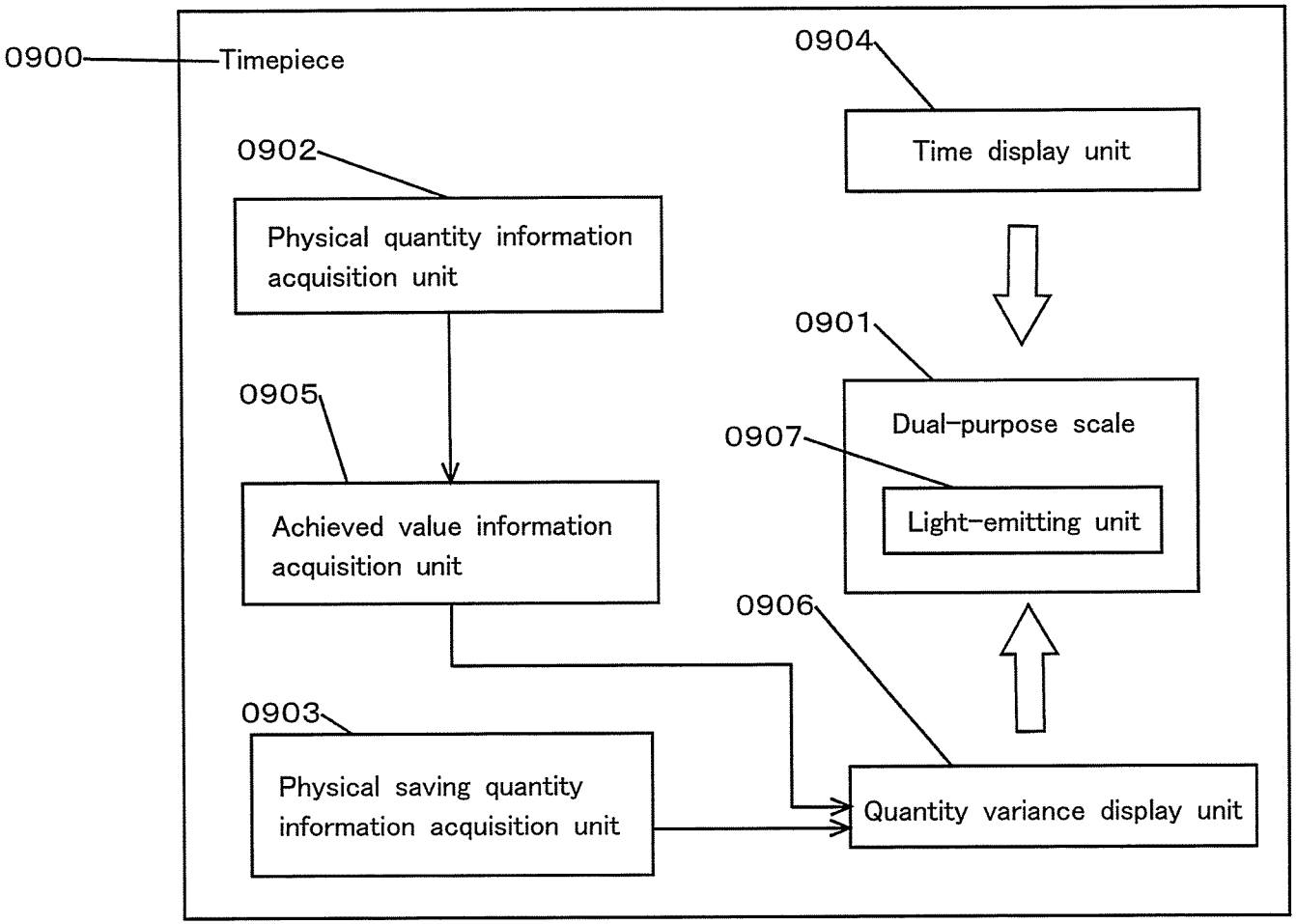
FIG. 9 is a diagram showing an example of a functional block of the timepiece of the second embodiment.

FIG. 9 is a diagram showing an example of a functional block of the timepiece of the second embodiment. As described in FIG. 9, a "timepiece" 0900 of the second embodiment comprises a "dual-purpose scale" 0901, a "physical quantity information acquisition unit" 0902, a "physical saving quantity information acquisition unit" 0903, a "time display unit" 0904, an "achieved value information acquisition unit" 0905, a "quantity variance display unit" 0906, and a "light-emitting unit" 0907. The basic configuration is the same as that of the timepiece explained in FIG. 2 of the first embodiment. Thus, explanations are given hereinafter with a central focus on the "light-emitting unit," which is not included in the configuration of the first embodiment.

The "light-emitting unit" retains the function for displaying information to be shown on the dual-purpose scale using multicolored light-emitting unit components. The term "multicolored light-emitting unit components" specifically refers to light-emitting unit components that make multicolored light emission possible, such as LED elements and EL elements. It also refers to a display surface corresponding to bars of the dual-purpose scale that indicates time and physical quantities to be controlled via a form of light-emitting or blinking-light-emitting unit components, etc.

An example of a light-emitting method upon time display includes a method in which a single bar of the dual-purpose scale is newly added for the elapse of each unit of time (e.g., 1 minute), and such portion become luminous. In addition, the following possible examples also exist: a method in which, upon commencement of a predetermined time, the entire display surface of the dual-purpose scale becomes luminous and the light-emitting portion corresponding to bar(s) indicating the current time for each elapse of the relevant unit of time is turned off; a method in which only the bar of the dual-purpose scale indicating the current time becomes luminous or only the bar of the dual-purpose scale indicating the current time becomes luminous in a different color from that of other portions, thereby allowing users' attention to be concentrated upon such bar portion; and a method in which a corresponding display unit portion blinks based on any of the methods described above. By adopting of any of the configurations described above, the dual-purpose scale indicates both time and physical quantities to be controlled in a manner such that the scale is visible in a dark location in which the timepiece is located as well as in a bright location. Thus, it is possible for users to recognize visually the degree of achievement of the target physical saving quantity in relation to the achieved value to be controlled as well as time.

Concrete Configuration

Figure 10:
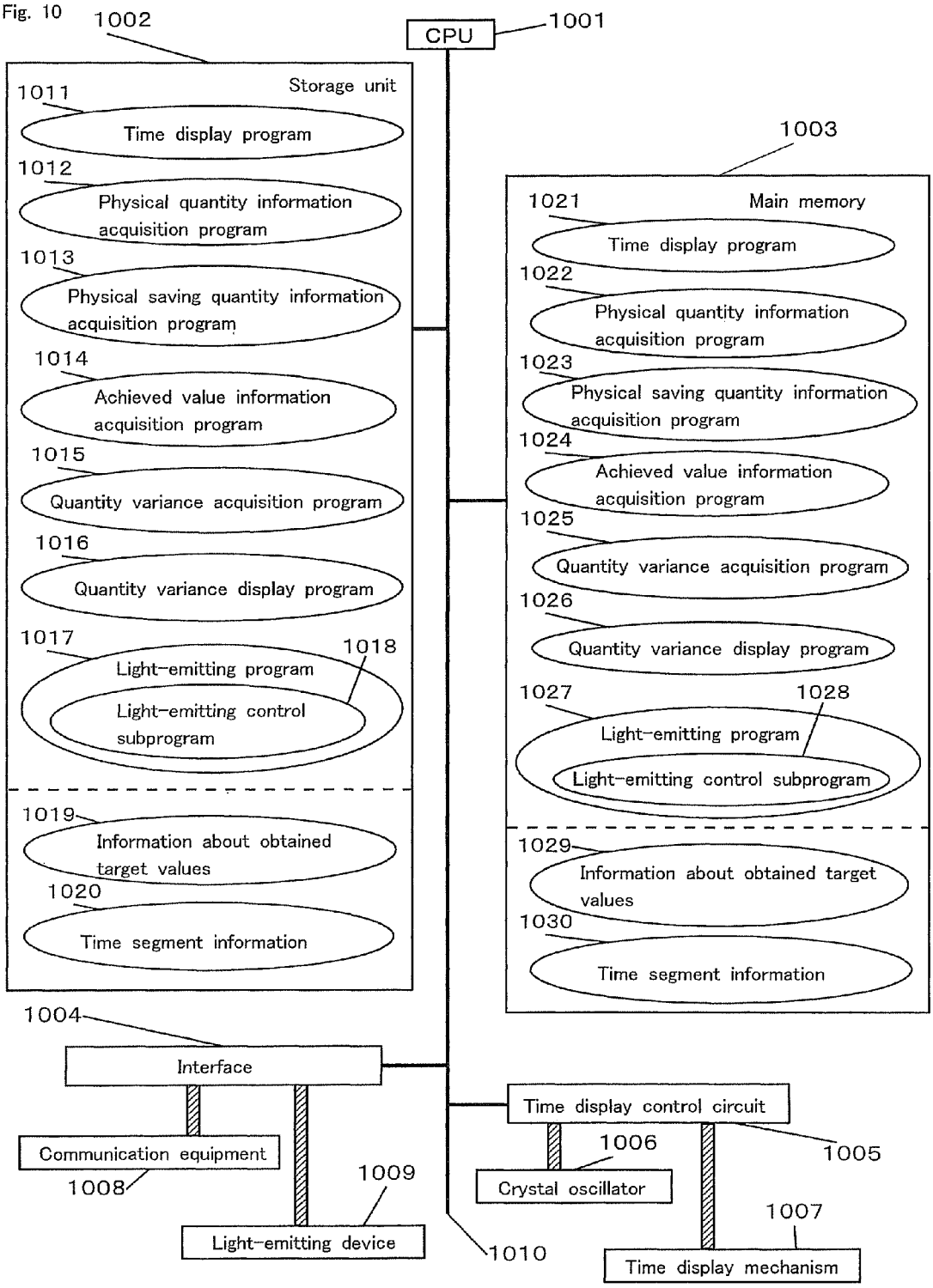
FIG. 10 is a diagram showing an example of a hardware configuration of the timepiece of the second embodiment.

FIG. 10 is a schematic diagram showing an example in which functional configuration of the timepiece described above is implemented as hardware. Operations for hardware configuration units are explained hereinafter with reference to FIG. 10.

As described in FIG. 10, the timepiece comprises a "CPU" 1001, a "storage unit (storage medium)" 1002, a "main memory" 1003, an "interface" 1004, and a "time display control circuit" 1005. The time display control circuit transmits and receives signals with a "crystal oscillator" 1006 and a "time display mechanism" 1007. It is possible for the interface to transmit and receive signals and the like with "communication equipment" 1008 and a "light-emitting device" 1009. The configuration described above is connected via a data communication path, which is a "system bus" 1010, and transmission, receipt, and processing of information takes place. In addition, the light-emitting device comprises the number of light-emitting elements corresponding to the number of bars of the dual-purpose scale allocated on the display unit with a function for displaying bars of the dual-purpose scale. As described above, the concrete configuration of the timepiece of the second embodiment is basically the same as that of the first embodiment. In particular, processes for a light emission control circuit and the light-emitting device, which are not included in the first embodiment, are explained hereinafter.

Concrete Processing Via Light-Emitting Unit

The CPU executes a "light-emitting program" 1027, and processes illumination of light-emitting elements corresponding to the aforementioned information quantity variance for the light-emitting device via the interface.

Progression of Process of Second Embodiment

Figure 11:
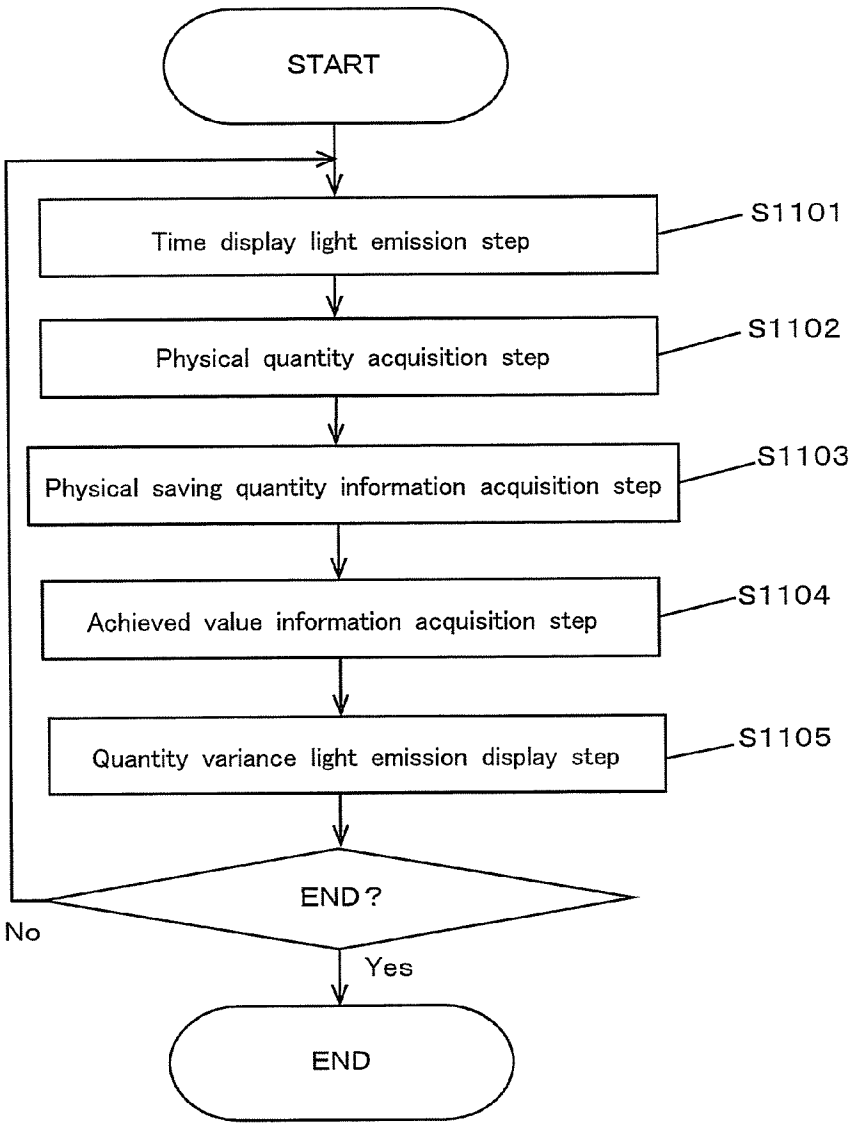
FIG. 11 is a diagram showing the progression of the process of the timepiece of the second embodiment.

FIG. 11 is a diagram showing the progression of the process of the timepiece of the second embodiment. The progression of the process of FIG. 11 comprises the following steps. Initially, scale display for indicating the dual-purpose scale based on the time takes place using a light-emitting means (S1101: time display light emission step). Subsequently, the physical quantity information reckoned from a predetermined time is obtained (S1102: physical quantity acquisition step). Next, the information about average physical quantity in the form of an average resulting when obtained target values are divided by a time segment length is obtained, and the physical saving quantity information to be obtained reckoned from a predetermined time until the current time is obtained (S1103: physical saving quantity information acquisition step). Next, achieved value information representing the value achieved up to the current time for a quantity achieved for the physical quantity controlled within a given time segment is acquired (S1104: achieved value information acquisition step). Quantity variance resulting when physical saving quantity value is subtracted from the achieved value is computed, and scale display indicating the dual-purpose scale based on the corresponding quantity variance takes place (S1105: quantity variance light emission display step).

Brief Description of Effects of Second Embodiment

In addition to the effects of the first embodiment, the timepiece of the second embodiment makes it possible to indicate time and physical quantities to be controlled in a form of light emission using a plurality of colors. Thus, the degree of target achievement and time can be more easily understood.

Third Embodiment

Concept of Third Embodiment

A timepiece of a third embodiment is basically the same as that explained in the second embodiment. Furthermore, the timepiece of the third embodiment is characterized by further comprising a light-emitting control unit that controls a light-emitting unit such that a scale area representing the higher value than the value for the current time and a scale area representing the lower value than the value for the current time become luminous in different predetermined colors. Such configuration makes it easy to know, based solely upon the luminous colors of a dual-purpose scale, and without the need to read the dual-purpose scale intentionally, whether or not achieved value at the current time is higher or lower than physical saving quantity.

Functional Configuration of Third Embodiment

Figure 12:
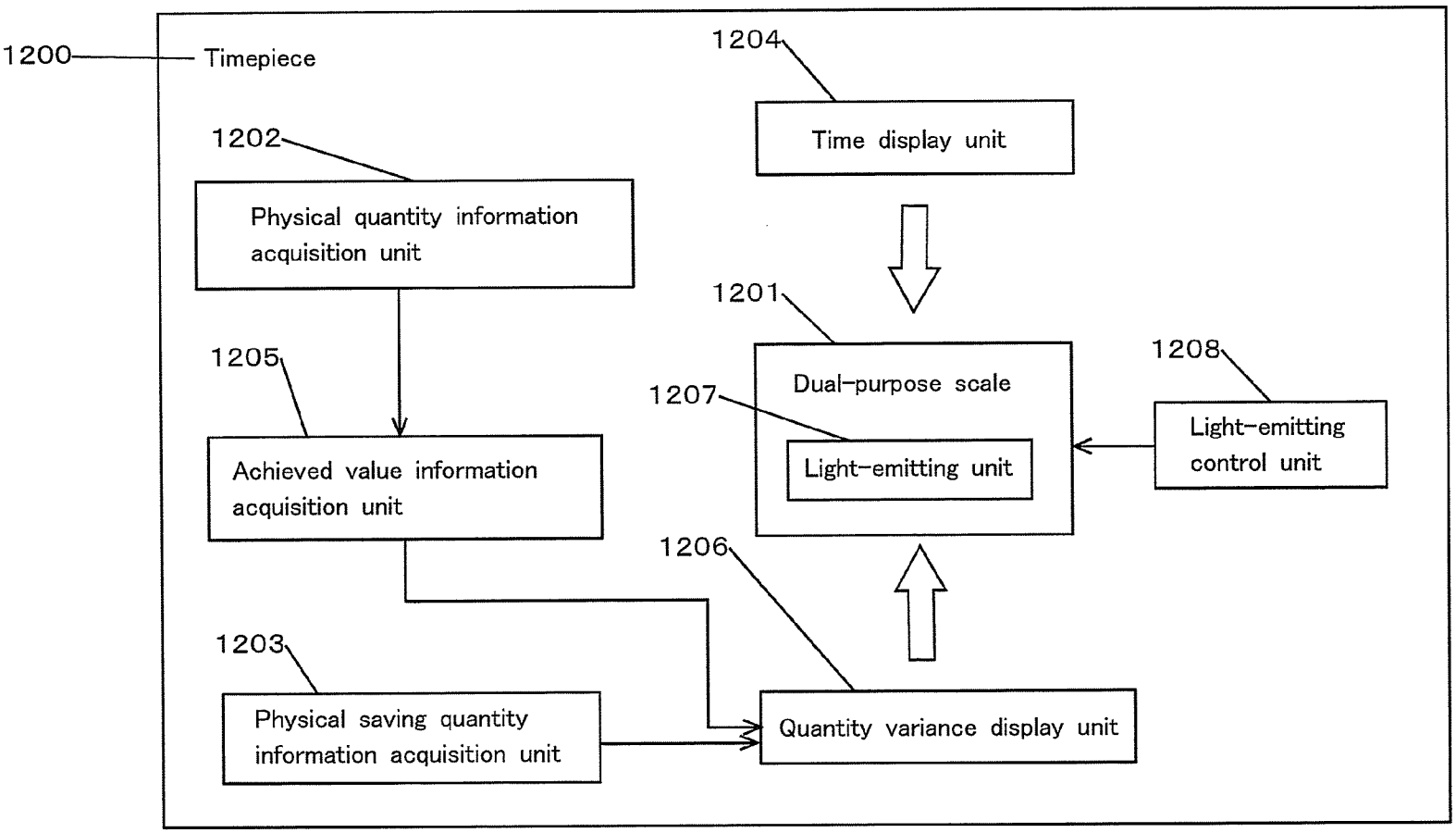
FIG. 12 is a diagram showing an example of a functional block of a timepiece of a third embodiment.

FIG. 12 is a diagram showing an example of a functional block of the timepiece of the third embodiment. As described in FIG. 12, a "timepiece" 1200 of the third embodiment comprises a "dual-purpose scale" 1201, a "physical quantity information acquisition unit" 1202, a "physical saving quantity information acquisition unit" 1203, a "time display unit" 1204, a "achieved value information acquisition unit" 1205, a "quantity variance display unit" 1206, a "light-emitting unit" 1207, and a "light-emitting control unit" 1208. The basic configuration is the same as that of the timepiece explained in FIG. 9 of the second embodiment. Thus, explanations are given hereinafter with a central focus on the "light-emitting control unit," which is not included in the configuration of the second embodiment.

The "light-emitting control unit" comprises a controlling function such that a scale area representing the higher value than the value for the current time and a scale area representing the lower value than the value for the current time become luminous in different predetermined colors. The expression "... become luminous in different predetermined colors" refers to methods in which, in case that quantity variance is indicated on a scale area representing the higher value than the value for the current time, luminous display takes place in red, and in case that quantity variance is indicated on a scale area representing the lower value than the value for the current time, luminous display takes place in blue, for example. Users recognize whether or not achieved value exceeds physical saving quantity based on differences between the aforementioned colors, and respond in a relevant manner based on the corresponding results. Thus, it is desirable to select different colors, such as red and blue, or black and white, as the colors used for the corresponding results so that users can easily recognize the difference between such results.

Concrete Configuration of Control Device

A hardware configuration of the timepiece of the third embodiment is basically the same as that of the timepiece of the second embodiment explained with reference to FIG. 10.

Concrete Processing Via Light-Emitting Control Unit

The CPU executes a "light-emitting control subprogram" 1028. In case that the aforementioned light-emitting elements are turned on, the CPU executes processes for turning on light-emitting elements with different color information for a scale area representing the higher value than the value for the current time and a scale area representing the lower value than the value for the current time.

Brief Description of Effects of Third Embodiment

Figure 13:
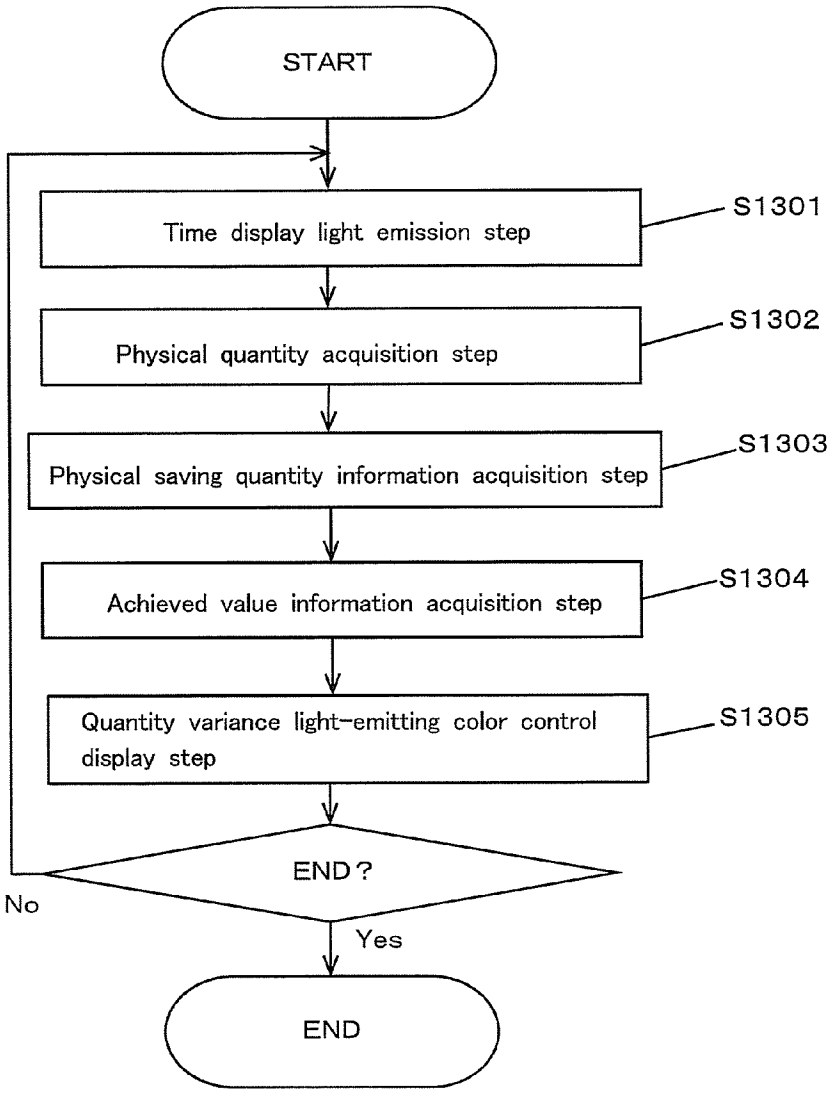
FIG. 13 is a diagram showing the progression of the process of the timepiece of the third embodiment.

FIG. 13 is a diagram showing the progression of the process of the timepiece of the third embodiment. The progression of the process of FIG. 13 comprises the following steps. Initially, scale display for indicating the dual-purpose scale based on the time takes place using a light-emitting means (S1301: time display light emission step). Subsequently, the physical quantity information reckoned from a predetermined time is obtained (S1302: physical quantity acquisition step). Next, the information about average physical quantity in the form of an average resulting when obtained target values are divided by a time segment length is obtained, and the physical saving quantity information to be obtained reckoned from a predetermined time until the current time is obtained (S1303: physical saving quantity information acquisition step). Next, achieved value information representing the value achieved up to the current time for a quantity achieved for the physical quantity controlled within a given time segment is acquired (S1304: achieved value information acquisition step). Quantity variance resulting when physical saving quantity value is subtracted from the achieved value is computed, and scale display indicating the dual-purpose scale based on the corresponding quantity variance takes place and luminous display takes place using different colors depending on whether or not the corresponding value is of a positive nature or a negative nature (S1305: quantity variance light-emitting color control display step).

Brief Description of Effects of Third Embodiment

The timepiece of the third embodiment makes it easy to know, based solely upon the luminous colors of a dual-purpose scale, and without the need to read the dual-purpose scale intentionally, whether or not achieved value at the current time is higher or lower than physical saving quantity.

What is claimed is:

1. A timepiece comprising:

a dial that has time characters;

a dual-purpose scale display that is provided at a periphery of the dial and that is configured to display:

minute information without using a minute hand, and a physical quantity, the dual-purpose scale display including a light-emitting unit using multicolored light-emitting components for displaying the minute information and the physical quantity;

a physical quantity acquisition unit that is configured to obtain the physical quantity associated with time;

a target cumulative physical quantity acquisition unit that is configured to obtain a target cumulative physical quantity, the target cumulative physical quantity being the physical quantity accumulated by a current time in consideration of an average physical quantity that is obtained by dividing a target physical quantity by an elapsed time;

an achieved cumulative physical quantity acquisition unit that is configured to obtain an achieved cumulative physical quantity, the achieved cumulative physical quantity being the physical quantity actually achieved and accumulated by the current time based on the physical quantity acquisition unit;

a quantity difference display unit that is configured to obtain a quantity difference by subtracting the target cumulative physical quantity from the achieved cumulative physical quantity and that displays the quantity difference in the dual-purpose scale display; and a light-emitting control unit that is configured to control the light-emitting unit so as to emit either a first color or a second color, wherein when the quantity difference is a positive value, the quantity difference is displayed in a clockwise position in the first color with respect to a minute position for displaying the minute information of the current time, and when the quantity difference is a negative value, the quantity difference is displayed in a counterclockwise position in the second color with respect to the minute position.

2. The timepiece according to claim 1, wherein a first distance difference between the clockwise position and the minute position corresponds to the positive value, and a second distance difference between the counterclockwise position and the minute position corresponds to the negative value.

3. The timepiece according to claim 1, wherein the dial has hour hand to display hour information of the current time.

4. The timepiece according to claim 1, wherein the physical quantity is one of a power consumption amount and an operation speed of a treadmill.

5. The timepiece according to claim 1, wherein the physical quantity acquisition unit is configured to obtain the physical quantity by using one of a temperature sensor, an accelerometer, an operation input device, a wired communication line, or a wireless communication line.

6. The timepiece according to claim 1, wherein the physical quantity acquisition unit is configured to obtain the physical quantity in a cycle time that is less than one minute.

7. The timepiece according to claim 1, wherein the quantity difference is updated every minute so that a latest a quantity difference is displayed on the dual-purpose scale display.

* * * * *